US009340945B1

(12) United States Patent
Bye

(10) Patent No.: US 9,340,945 B1
(45) Date of Patent: May 17, 2016

(54) GROUND ANCHOR DEVICE

(71) Applicant: Robert Franklin Bye, Russellville, MO (US)

(72) Inventor: Robert Franklin Bye, Russellville, MO (US)

(73) Assignee: ROBERT FRANKLIN BYE, Russellville, MO (US)

( * ) Notice: Subject to any disclaimer, the term of this patent is extended or adjusted under 35 U.S.C. 154(b) by 1 day.

(21) Appl. No.: 14/545,171

(22) Filed: Apr. 2, 2015

(51) Int. Cl.

| | |
|---|---|
| ***E04H 12/22*** | (2006.01) |
| ***E02D 5/80*** | (2006.01) |
| ***E21D 20/00*** | (2006.01) |
| ***E21D 21/00*** | (2006.01) |

(52) U.S. Cl.
CPC *E02D 5/80* (2013.01); *E21D 20/00* (2013.01); *E21D 21/0026* (2013.01); *E21D 21/0086* (2013.01)

(58) Field of Classification Search
CPC ..... E04H 12/2215
See application file for complete search history.

(56) References Cited

U.S. PATENT DOCUMENTS

| | | | | | |
|---|---|---|---|---|---|
| 1,764,207 | A | * | 6/1930 | Johnson | 52/151 |
| 2,812,743 | A | * | 11/1957 | Ernest | 119/780 |
| 2,983,345 | A | * | 5/1961 | Langer | 52/127.5 |
| 3,896,596 | A | * | 7/1975 | Berger | 52/153 |

FOREIGN PATENT DOCUMENTS

| | | | | | |
|---|---|---|---|---|---|
| GB | 119116 | A | * | 9/1918 | E02D 5/80 |
| GB | 2090211 | A | * | 7/1982 | B60S 9/04 |

* cited by examiner

*Primary Examiner* — Tara M. Pinnock

(57) ABSTRACT

One embodiment of an anchor device for ground application and of the type having a main shaft (28) which connects at its top with a ground plate (20) with oblong holes for additional shafts (22) so as to increase holding ability. In addition a coupler (24) connects to the top side of the anchor. Other possible embodiments are described.

1 Claim, 3 Drawing Sheets

GROUND ANCHOR DEVICE

CROSS-REFERENCE TO RELATED APPLICATIONS

This application claims the benefit of provisional patent application Ser. No. 61/995,156, filed 2014 Apr. 2 by the present inventor.

The mechanics of attaching items to the ground vary from the simple to the complex. Generally speaking, a mechanism is driven into the ground with varying degrees of holding capability.

The majorities of these anchors are meant to be semi-permanent due to the limited capability they possess. Some of the more permanent anchors involve drilling holes in the earth and filling with cement, followed by placing a coupler into the wet cement and then waiting for the application to set up and cure before being able to be utilized.

Common ground anchor systems are known to suffer from a number of disadvantages:

(a) their applications lack strength in performance and durability;

(b) their semi-permanent nature give them a probability of failure when tested;

(c) an anchor required for a large application tends to be an expensive and time consuming installation, yet still deals with the probability of failure.

SUMMARY

In accordance with one embodiment, the ground anchor comprises a coupler, a ground plate, and a main shaft giving direction of installation into ground.

Advantages

Accordingly, several advantages of one or more aspects are as follows: to provide ground anchors that are permanent, minimally invasive to the ground, relatively inexpensive, easily installed, and supply extreme durability in usage. Other advantages of one or more aspects will be apparent from an examination of the drawings and ensuing description.

DRAWINGS

Figures

DRAWINGS

Reference Numerals

Figures 1A, 1B:
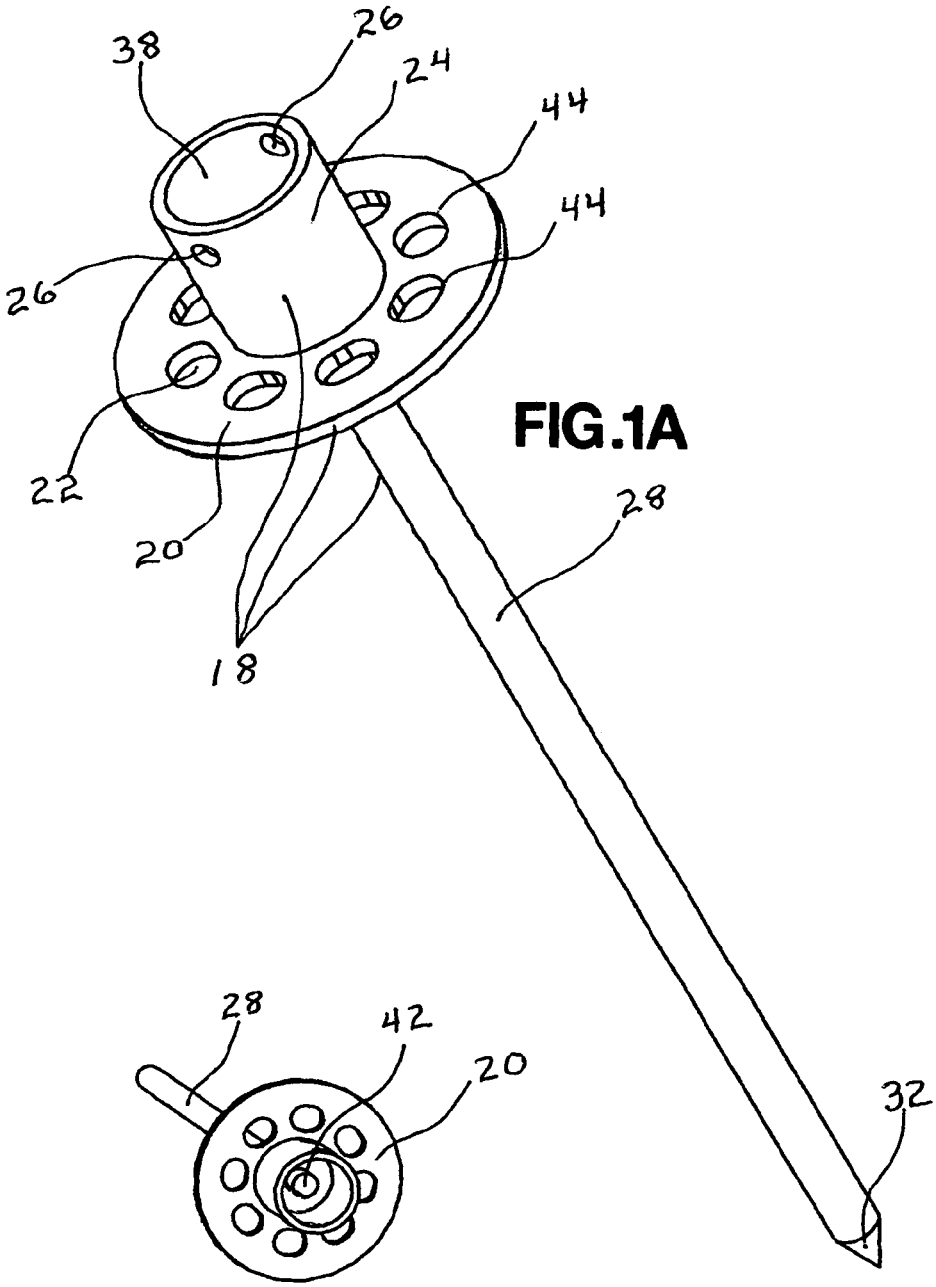
FIGS. 1A to 1B show two 3-dimensional views of one embodiment.

18 ground anchor device
20 ground plate
22 oblong holes for additional shafts
24 coupler
26 bolt holes
28 main shaft
32 chamfer point
38 coupler opening
42 main shaft protruding
44 additional shaft areas to connect
48 top of coupler areas to connect

DETAILED DESCRIPTION

Figure 2:
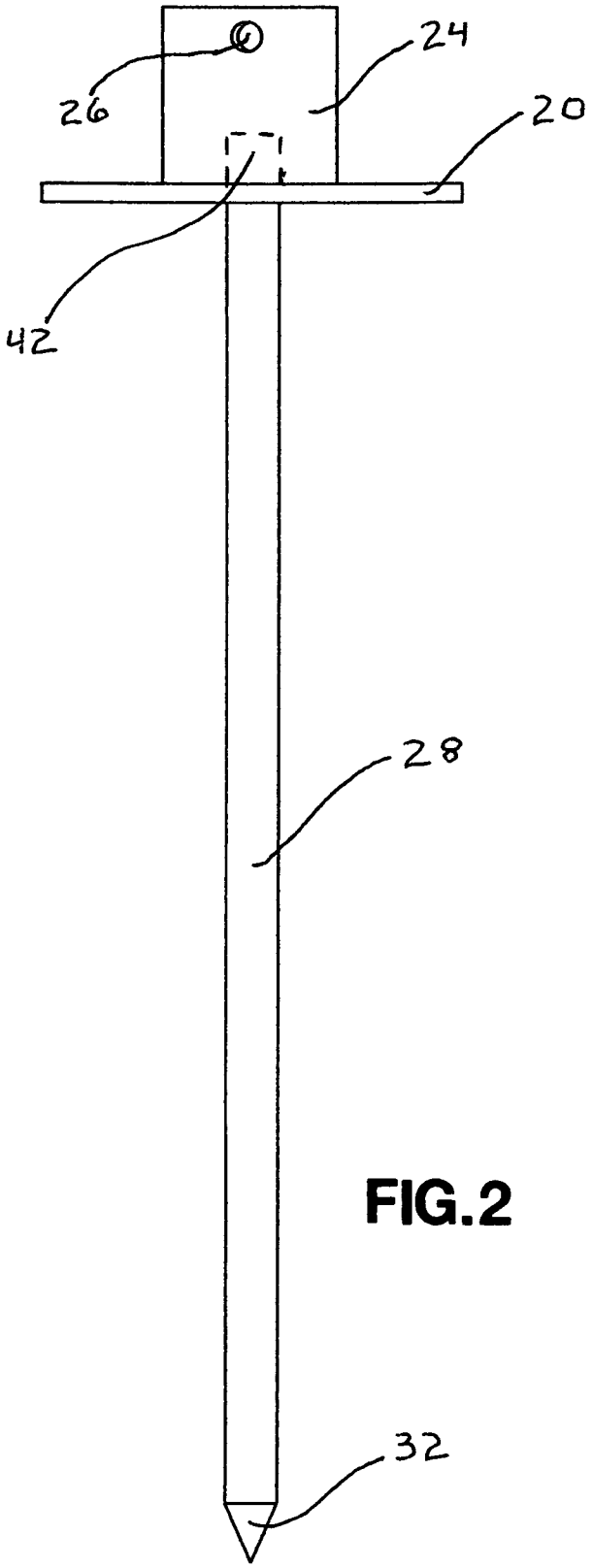
FIG. 2 shows a direct side view of one embodiment.
Figure 3:
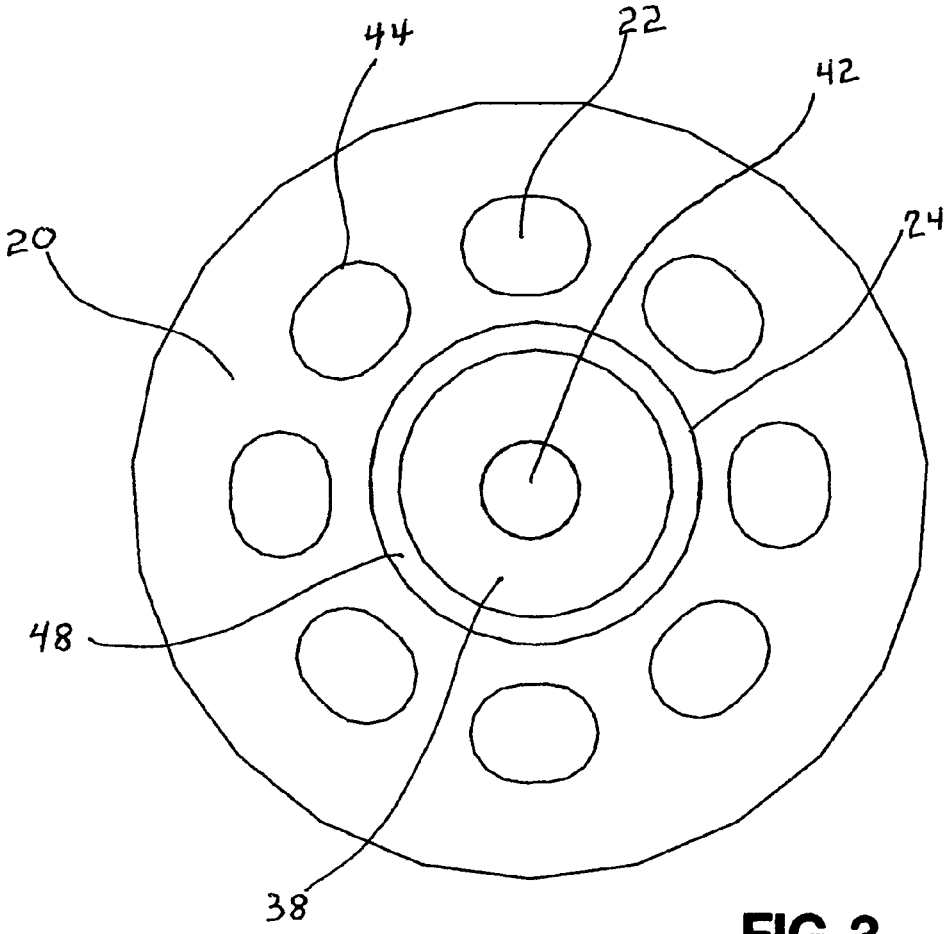
FIG. 3 shows a direct top view of one embodiment.

FIGS. 1*a* and 1*b*, FIG. 2, and FIG. 3

First Embodiment

Ground anchor device 18 comprises a main shaft 28 connecting a ground plate 20, which in turn is connected to a coupler 24. Length of main shaft 28 is designed for quick and secure placement of ground anchor device 18. Coupler 24 has bolt holes 26 which allow whatever is inserted to be secured with a bolt. Top of coupler area 48 provides additional area for securing.

Ground plate 20 has oblong holes 22 for insertion of additional shafts into ground plate 20. The width of the oblong holes 22 are sized according to the diameter of the additional shafts creating a snug fit, while the length of the oblong holes 22 are sized to allow varying angles of installment of additional shafts. After additional shafts are installed they are connected in place.

Main shaft 28 with top of main shaft protruding 42 and bottom of main shaft 28 showing chamfer 32. Main shaft 28 is connected to ground plate 20 of ground anchor device 18 and additional shafts are driven in place. In addition, additional shafts are left protruding slightly out of ground plate 20 prior to connecting.

Operation

Initially, chamfer 32 end of main shaft 28 is driven vertically into ground to the bottom of ground plate 20. Driving of main shaft 28 into ground is accomplished with a powered device such as a demolition hammer with driver bit placed over main shaft 28 that is protruding 42 to accompany driver bit. Once ground anchor device 18 is driven snugly into the ground, the next step is driving additional shafts through oblong holes 22 into the ground. Once additional shafts are driven into place, it is time to connect them at areas to connect 44.

Once the additional shafts are connected, the installed ground anchor device 18 is now ready to accept pipe, pole, cable, chain, rope, wire, also different shaped items such as square or triangle post by the use of an adapter to connect up to coupler 24, secure attachment by bolt at bolt holes 26, or a connection at top of coupler connection area 48 or both.

To summarize, my invention comprises a coupler, ground plate, and main shaft able to be accurately driven into the ground where needed and, along with driven additional shafts, becoming more secure with each additional shaft added and then connected in place forming an expanded underground anchorage and support structure.

ADVANTAGES

From the description, a number of advantages of one embodiment of my ground anchor device becomes evident.

(a) The ground plate is able to hold many secondary shafts at a centralized location, providing a reinforced center point of anchor placement and structure.

(b) The nature of additional shafts, uniformly spread out, supplies a broad base of strength, increasing anchor durability.

(c) The connecting of all pieces involved provides a more permanent application, fortifying durability and duration of installation.

CONCLUSION, RAMIFICATIONS, AND SCOPE

Furthermore, the reader will see that the embodiments of the ground anchor device have the additional advantages in that:

It is more durable;

It is quicker to install;

It is minimally disturbing to the ground;

It is more versatile;

It is suitable for a wide range of ground conditions;

It is cost effective;

It is frost heave resistant;

It is suitable for a wide range of anchoring and support duties;

It is earthquake resistant; and

It is suitable for anchoring most anything to the ground.

Although the description above contains many specificities, these should not be thought as to limit the scope of the embodiments, but as simply providing illustration as one of several embodiments. For example, the coupler can have other shapes, such as rectangular, square, etc.; the main shaft and ground plate can have other shapes also.

Thus, the scope of the embodiments should be determined by the appended claims and their legal equivalents, rather than by examples given.

I claim:

1. A ground anchor comprising:

a round center shaft having a chamfer point at one end thereof;

a ground-engaging plate positioned proximate the other end of the center shaft and being circular in shape, and further including eight oblong shaped holes evenly spaced within the outer periphery of the ground engaging plate;

a round coupler connected to the center of the ground-engaging plate opposite the side from which the chamfer point extends, and being shaped as a receiver configured to accept a round member therein; and a count of eight additional round shafts in the oblong holes of the ground-engaging plate and configured to be welded at their ends proximal the ground-engaging plate, thereby creating an octagonal array of subterranean anchoring shafts.

* * * * *